United States Patent [19]

Borg

[11] 4,045,106

[45] Aug. 30, 1977

[54] AUTOMATIC ELECTRICAL PLUG RELEASE

[76] Inventor: John P. Borg, 30 Fontenay Court No. 502, Islington, Ontario, Canada, M9A 4W5

[21] Appl. No.: 658,510

[22] Filed: Feb. 17, 1976

[51] Int. Cl.[2] ..... H01R 13/62

[52] U.S. Cl. ..... 339/45 R

[58] Field of Search ..... 339/45, 46, 34

[56] References Cited

U.S. PATENT DOCUMENTS

| | | | |
|---|---|---|---|
| 2,551,382 | 5/1951 | Lindsay | 339/45 R |
| 3,926,494 | 12/1975 | Maillaro | 339/34 |

*Primary Examiner*—Francis S. Husar
*Assistant Examiner*—John McQuade
*Attorney, Agent, or Firm*—George H. Riches

[57] ABSTRACT

An automatic electric plug release consisting of a hollow receptacle in which the electrical plug is spring mounted. The spring is held under compression by a rotatable mounting member on which the electrical plug is mounted. The spring is mounted between the rotatable member and an inside flange on the bottom portion of the casing. A cover is removably mounted on the casing and is formed with at least two lugs which engage the rotatable member to hold it in a locked position to compress the spring. In the latter position the terminal prongs project out from the receptacle and may be inserted into an electrical wall socket. The cover has an angled sleeve through which the electrical cord is introduced and connected to the electrical socket in the usual manner. A pull on the electrical cord will rotate the mounting member sufficient to release the member from the locked position and allow the spring action to actuate the member upwards and withdraw the terminal prongs from the socket.

4 Claims, 6 Drawing Figures

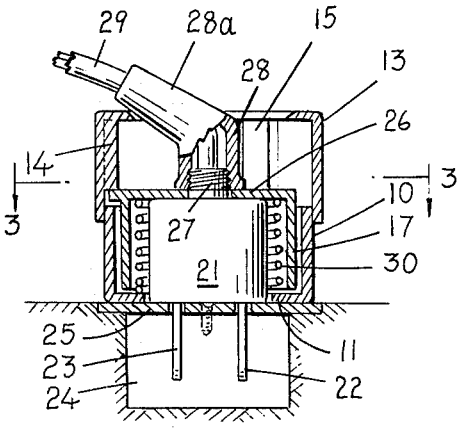
Fig. 1.
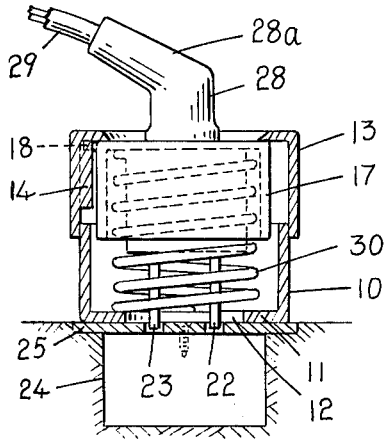
Fig. 2.
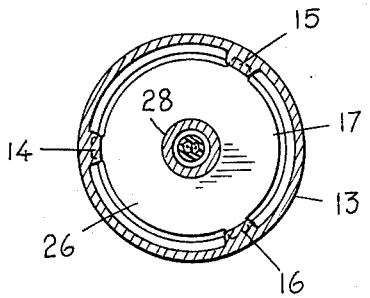
Fig. 3
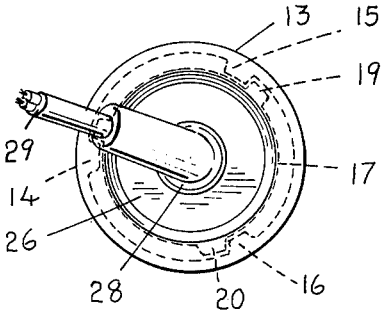
Fig. 4.
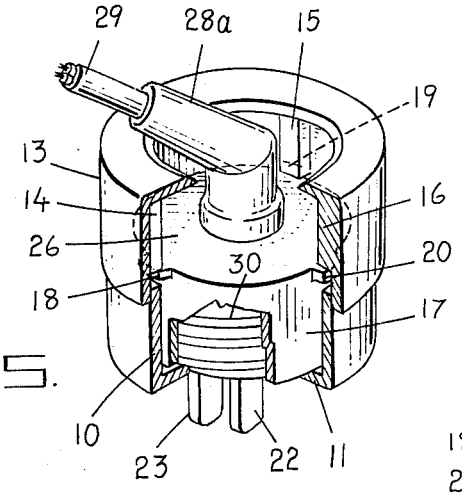
Fig. 5.
Fig. 6.
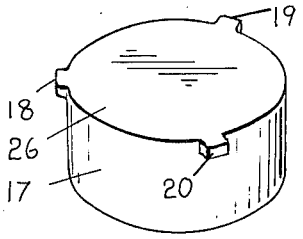

AUTOMATIC ELECTRICAL PLUG RELEASE

BACKGROUND OF THE INVENTION

The terminal plug for electric equipment such as vacuum cleaners, floor polishers, portable hand tools are subject to great strain on the connection between the cord and the plug when the plug's terminal prongs are held in the electrical wall socket, when the plug is in the wall socket and the cord is pulled during use. In many cases this results in the cord breaking at the connection between the plug and the cord resulting sometimes, in a short circuit. Also as the electrical plug has to be removed from the socket, by hand, such short circuit creates an electrical hazard for the person making the disconnect. Furthermore, to avoid such hazards, and often if no hazard is present, the person, using the electrical equipment, will give the electrical cord a sharp pull to accomplish the disconnection which frequently breaks or weakens the connection between the plug and cord.

OUTLINE OF THE INVENTION

The present invention provides an automatic electric plug release which automatically, by a slight pull on the electrical cord, withdraws the plug and its terminal prongs from the electric wall socket into which its terminal prongs have been inserted.

The automatic electric plug release is one of its embodiments consists essentially of i. a receptacle having a hollow cylindrically shaped base portion with a substantially wide opening therethrough said base portion being seatable against the outer wall plate of an electric wall socket, and a cylindrically shaped top portion having at least two equally spaced lugs projecting inwardly, from opposed positions on the inside wall thereof;

ii. an inverted cup shaped mounting member mounted in the receptacle for rotative and up-and-down movement between a locked position and an unlocked position;

iii. an electrical plug mounted in the mounting member for rotative movement thereon and up-and-down movement therewith;

a coiled compression spring mounted in the mounting member between said mounting member and said base portion, said spring surrounding said electrical plug;

v. complemental ears on the mounting member engageable with said lugs when the mounting member is depressed and rotated in one direction whereby the mounting member and electrical plug are held in the locked position with the terminal prongs extending outwardly from the base; and vi. an electrical cord sleeve for an electric cord mounted on the top of the electric plug and extending through the top portion whereby on pulling on the electrical cord, the mounting member is rotated and released from the locked position and moved upwardly to the unlocked position, thereby withdrawing the prongs from the socket.

DESCRIPTION OF THE INVENTION

The drawings illustrate one embodiment of the invention in which:

FIG. 1 is a vertical cross section taken substantially through centre of the automatic electric plug release showing the parts in the locked position.

FIG. 2 is a cross section similar to FIG. 1 showing the electric plug in the unlocked position.

FIG. 3 is a horizontal cross section on the line 3—3 of FIG. 1.

FIG. 4 is a top plan view.

FIG. 5 is a front elevation, with the front broken open to further illustrate the construction.

FIG. 6 is a perspective view of the cup shaped mounting member.

The automatic electric plug release comprises a hollow cylindrical receptacle consisting of a cylindrical shaped base portion 10 having an annular inturned flange 11 defining a substantially wide circular opening 12 therethrough, and a hollow cylindrical shaped top portion 13 which is mounted on top of the base portion. The top portion, in the instant exemplification, has three lugs 14, 15 and 16 which are equally spaced and which project inwardly, in the form of ribs, from inside wall of the top portion and reach almost to the base portion as will be described later.

Mounted within the base portion is an inverted cup-shaped mounting member 17 which has three locking ears 18, 19, 20. The purpose of these ears will be described later. Mounted inside the member 17 is a conventional electric plug 21 having terminal prongs 22, 23 which fit into the conventional wall socket 24 covered by plate 25. The plug is mounted on the top part 26 of member 17 with its threaded neck portion 27 projecting therethrough. An electrical cord sleeve 28 is threadedly attached to the projecting part of portion 27. With this type of attachment, member 17 has rotative movement relative to the socket 24. The sleeve 28 is inclined, as shown at **28*a*, relative to the axis of rotation of the member 17. The sleeve thus serves the function of a crank. The electrical cord 29 of the appliance is entered through the sleeve 28 and connected to the plug 21 in the usual manner. Thus, by pulling on the cord 29, the cup shaped member 17 is rotated to release it from the top portion 13** as will be explained later.

A compression coil spring 30 is mounted inside the-mounting member 17, to surround the plug, with one end of the spring supported on the flange 11 and the other end bearing against the inside of the top part 26.

The automatic electric plug release is used in the following manner. To lock the plug in the locked position with the terminal prongs 22, 23 projected out through the wide opening 12, the person intending to use the appliance presses down on sleeve 28, compressing plug 30 until the ears are below the lower ends of lugs 14, 15, 16 and then rotates the member 17 until the lugs are engaged thereunder. The plug is then in the locked position and the prongs 22, 23 can be inserted into wall socket with the flange 11 seated on plate 25. The appliance is then ready for use. The plug can, of course, be removed in the usual way.

The automatic release operates in the following manner. With the plug in the locked position, and the prongs in the wall socket, the operator of the appliance, gives a pull on the cord of sufficient force to rotate the ears 18, 19, 20 out of engagement with the lugs. The spring actuates the mounting member and plug 21 upwardly to automatically move the plug to the unlocked position and thus withdraw the prongs from the socket.

I claim:

1. An automatic electric plug release comprising:

i. a hollow receptacle having a base portion with a substantially wide opening therethrough said base portion being seatable against the outer surface of an electrical wall socket and a top portion having at least two equally spaced lugs projecting inwardly from opposed portions on the inside wall thereof;

ii. a mounting member within the receptacle, said member having rotative, and up-and-down movement between a locked position and an unlocked position;

iii. an electrical plug mounted on the mounting member. and having its terminal prongs extendable through the opening in the base portion and an electrical cord connected of said prongs;

iv. a compression spring mounted in the receptacle between said mounting member and said base portion;

v. complemental ears on the mounting member engageable with said lugs when the mounting member is depressed and rotated in one direction whereby the mounting member and electrical plug are held in the locked position with the terminal prongs extending outwardly from the base; and vi. an electrical cord sleeve mounted on the top of the electric plug and enclosing said cord, said electrical cord sleeve being inclined relative to the axis of rotation of the mounting member whereby on pulling on said cord the mounting member is rotated and released from the locked position and actuated to the unlocked position thereby withdrawing the prongs from the socket.

2. An automatic electric plug release according to claim 1 wherein the top portion has three equally spaced lugs.

3. An automatic plug release according to claim 1 in which each lug has a cam-like surface engageable against the respective ear.

4. An automatic electric plug release according to claim 1 in which the base portion and the top portion are of cylindrical shape and the mounting member is an inverted cylindrically shaped cup housing said plug and said spring.

* * * * *